US005685827A

United States Patent [19]

Shimizu

[11] Patent Number: 5,685,827

[45] Date of Patent: Nov. 11, 1997

[54] ROLLER MASSAGING DEVICE

[75] Inventor: Nobuzo Shimizu, Osaka, Japan

[73] Assignee: Daito Electric Machine Industry Company Limited, Osaka, Japan

[21] Appl. No.: 454,248

[22] PCT Filed: Dec. 10, 1993

[86] PCT No.: PCT/JP93/01795

§ 371 Date: Jun. 13, 1995

§ 102(e) Date: Jun. 13, 1995

[87] PCT Pub. No.: WO94/13244

PCT Pub. Date: Jun. 23, 1994

[30] Foreign Application Priority Data

Dec. 14, 1992 [JP] Japan ..... 4-333175

[51] Int. Cl.[6] ..... A61H 15/00

[52] U.S. Cl. ..... 601/87; 601/112; 601/113; 601/118; 601/128; 601/131

[58] Field of Search ..... 601/85, 87, 89, 601/93–5, 97, 101, 103, 112–3, 118, 128, 131, 134

[56] References Cited

U.S. PATENT DOCUMENTS

| | | | |
|---|---|---|---|
| 1,635,497 | 7/1927 | Ruttger-Pelli | 601/113 |
| 1,777,151 | 9/1930 | Ruttger-Pelli | 601/113 |
| 1,899,208 | 2/1933 | Murphy | 601/113 |

FOREIGN PATENT DOCUMENTS

| | | | |
|---|---|---|---|
| 50-12590 | 2/1975 | Japan . | |
| 62-30827 | 2/1987 | Japan . | |
| 4-114330 | 10/1992 | Japan . | |
| 4-297259 | 10/1992 | Japan . | |
| 4124144 | 11/1992 | Japan . | |
| 313679 | 6/1956 | Switzerland | 601/113 |
| 433985 | 8/1935 | United Kingdom | 601/85 |

*Primary Examiner*—Danton D. DeMille

*Attorney, Agent, or Firm*—Birch, Stewart Kolasch & Birch, LLP

[57] ABSTRACT

Conventional roller massaging devices can perform only massage resulting from rolling action and cannot perform combinational massage resulting from both kneading action and the rolling action. In view of the foregoing, the present invention provides a massaging device which can perform massage resulting from either the kneading action or the rolling action. Specifically, the massaging device (1) comprises a casing (5), a main shaft (2) vertically extending and rotatably inserted through the casing (5), a rotary table (4) having a central portion coupled to an upper end of the main shaft (2), a plurality of rotors (13) rotatably provided above a top face of the above rotary table (4) by means of subordinate shafts (14) each extending in parallel with the main shaft (2), massaging rollers (3) provided above the rotors (13) eccentrically with the subordinate shafts (14), a rotor operating system (A) for causing the rotors (13) to rotate around the respective subordinate shafts (14), a rotary table operating system (B) for causing the rotary table (4) to revolve around the main shaft (2), while inhibiting the rotation of the rotors (13) around the respective subordinate shafts (14), and a driving means 6) for activating either one of the rotor operating system (A) and the rotary table operating system (B).

16 Claims, 10 Drawing Sheets

ROLLER MASSAGING DEVICE

TECHNICAL FIELD

The present invention relates to roller massaging devices.

BACKGROUND ART

Conventionally, massaging devices for home use have been roughly divided into those of: kneading-ball type comprising a pair of kneading balls transversely mounted on a housing so that they can rock; vibrator type comprising a vibrator provided on one end of a hand-held cylindrical body; and roller type comprising a plurality of massaging rollers disposed on a rotary table in the circumferential direction thereof.

To be more specific about the roller-type massaging devices, the plurality of massaging rollers are circumferentially disposed at regular intervals on the rotary table rotatable around a main shaft. A driving means, such as an electric motor, is also provided to rotate the rotary table, so that the massaging rollers revolve together with the rotary table. When pressed onto a stiff part of a user's body, the revolving massaging rollers improve blood circulation in the stiff part, thereby exerting massaging effects (see Japanese Unexamined Utility Model publications SHO 62-30827 and HEI 4-114330).

However, the conventional roller-type massaging devices provide only massaging effects resulting from rolling action, since the massaging rollers are merely attached to the rotary table so that they can roll freely. As a result, if the user wants to have massaging effects resulting from kneading action as well, he should purchase another massaging device exclusively for kneading.

Even when a massaging device exclusively for kneading is combined with a massaging device exclusively for rolling, if the rolling action currently performed is to be switched to the kneading action, for example, the whole massaging device exclusively for rolling should be replaced with the whole massaging device exclusively for kneading. This selective use of the two massaging devices causes significant inconvenience to the user.

SUMMARY OF THE INVENTION

In view of the foregoing situation, an object of the present invention is to provide a roller massaging device which can perform massage resulting from either rolling action or kneading action and which implements easy switching between the two actions.

To attain the above object, the present invention provides the following technical means.

More specifically, a roller massaging device of the present invention comprises: a casing; a main shaft vertically extending and rotatably inserted through the casing; a rotary table having a central portion coupled to an upper end of the above main shaft; a plurality of rotors rotatably provided above a top face of the above rotary table by means of subordinate shafts each extending in parallel with the above main shaft; massaging rollers positioned above the rotors eccentrically with the above subordinate shafts; a rotor operating system for causing the above rotors to rotate around the above respective subordinate shafts; a rotary table operating system for causing the above rotary table to revolve around the above main shaft, while inhibiting the rotation of the above rotors around the above respective subordinate shafts; and a driving means for activating either one of the above rotor operating system and the above rotary table operating system.

According to the present invention, if the driving means activates the rotor operating system, the rotors rotate around the respective subordinate shafts, which allows the massaging rollers provided in the respective rotors to move independently over the rotary table, resulting in kneading action.

On the other hand, if the driving means activates the rotary table operating system, the rotary table revolves around the main shaft while inhibiting the rotation of the rotors around the respective subordinate shafts, which allows each of the massaging rollers to revolve around the main shaft while maintaining a given distance therebetween, resulting in rolling action.

Thus, according to the present invention, both rolling action and kneading action can be performed by a single roller massaging device, so that various massaging effects can be provided at reduced purchase cost.

The present invention also provides switching means which remarkably facilitates the switching between these actions.

As will be apparent in the following description of the most preferred embodiments, the switching means are roughly divided into those: which perform the switching between these actions by means of a slider for vertically moving a motor and its drive shaft in the casing (in the cases of first and second embodiments); and which perform the switching between these actions by operating a change-over switch provided on the casing without moving the driving means (in the case of a third embodiment).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which are given by way of illustration only, and thus are not limitative of the present invention, and wherein.

DETAILED DESCRIPTION OF THE PREFERRED EMBODIMENTS

Figure 1:
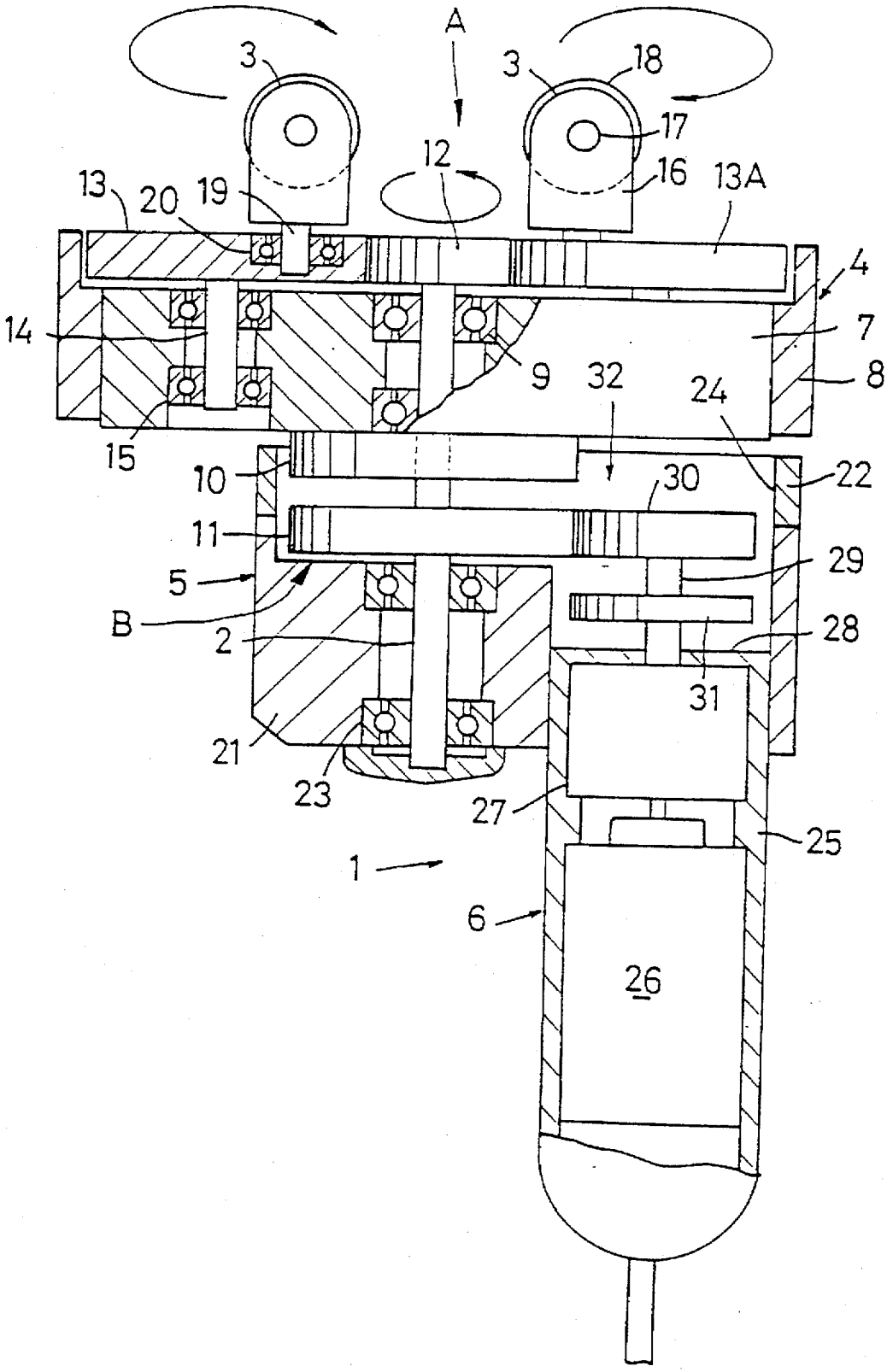
FIG. 1 is a front cross section of a roller massaging device according to a first embodiment of the present invention, which illustrates kneading action.

Below, the embodiments of the present invention will be described in detail with reference to the drawings.

FIGS. 1 to 4 show a first embodiment of the present invention.

In the drawings, a massaging device 1 according to the present embodiment comprises: a casing 5; a main shaft 2 vertically extending and rotatably inserted through the casing 5; a rotary table 4 having its central portion coupled to the upper end of the main axis 2; a plurality of rotors 13 rotatably held above the top face of the rotary table 4 by subordinate shafts 14 each extending in parallel with the main shaft 2; and massaging rollers 3 positioned above the rotors 13 eccentrically with the above respective subordinate shafts 14.

Figure 3:
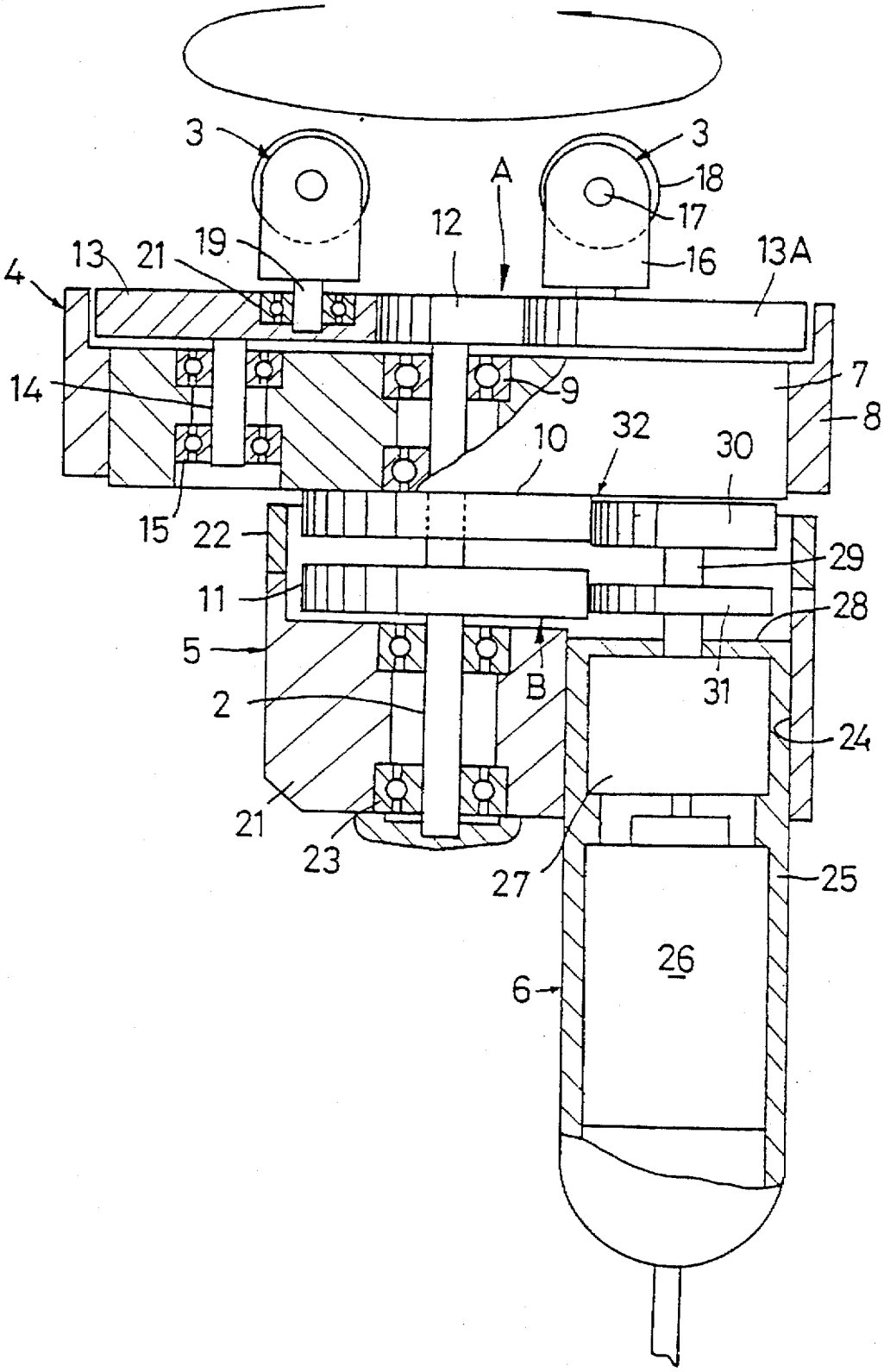
FIG. 3 is a front cross section of the roller massaging device according to the first embodiment, which illustrates rolling action.

The massaging device 1 also comprises: a rotor operating system A for causing the rotors 13 to rotate around the respective subordinate shafts 14, as shown in FIG. 1; a rotary table operating system B for causing the above rotary table 4 to revolve around the main shaft 2, while inhibiting the rotation of the rotors 13 around the respective subordinate shafts 14, as shown in FIG. 3; and a driving means 6 for operating either one of the rotor operating system A and the rotary table operating system B.

The rotary table 4 includes of a table body 7 in the form of a thick disk and a covering body 8 into which the table body 7 is fitted so that the outer circumference thereof is covered with the covering body 8. The upper portion of the main shaft 2 is inserted through a pair of upper and lower bearings 9 provided in the central portion of the table body 7, so that the rotary table 4 is supported rotatably around the main shaft 2.

To the midpoint of the main shaft 2 is secured a first transmission gear 11, which is designed to have the same diameter and the same number of teeth as a second transmission gear 10 positioned above. To the back face of the table body 7 is secured the above second transmission gear 10 concentrically with the table body 7. The main shaft 2 is inserted through the central portion of the second transmission gear 10 which is positioned at about the midpoint of the main shaft 2 so that it can rotate independently of the second transmission gear 10.

On the side of the top face of the table body 7 are disposed a central gear 12 secured to the upper end of the main shaft 2 and four rotors 13.

Each of the rotors 13 is attached to the rotary table 4 by means of the corresponding subordinate shaft 14 extending in the same direction as the main shaft 2 so that it can rotate independently of the rotary table 14. The rotors 13 are disposed at regular intervals in the direction of the rotation of the rotary table 4. The interval between any two adjacent rotors 13 corresponds to a quarter of the circumference of the rotary table 4.

In other words, the subordinate shafts 14 rotatably supported by the table body 7 via bearings 15 are positioned at midpoints between the center and circumference of the table body 7 and equally spaced by 90 degrees in the circumferential direction thereof, so that the central portions of the rotors 13 are secured to the upper ends of the respective subordinate shafts 14.

Each of the four rotors 13 is composed of a gear having a diameter smaller than that of the rotary table 4. Briefly, each of the rotors 13 comprises a gear 13A around itself, which is engaged in the outer circumference of the central gear 12. Accordingly, if the driving means 6 causes the main shaft 2 to rotate, all the rotors 13 are allowed to rotate around the respective shafts 14 via the central gear 12.

Thus, in the case of the present embodiment, the above rotor operating system A is constituted by: the gears 13A formed around the respective rotors 13: the main shaft 2 rotatably supporting the rotary table 4; the central Gear 12 engaged in the individual gears 13A and fixed to the upper end of the main shaft 2; and the first transmission gear 11 fixed to the main shaft 2 in a position below the rotary table 4. On the other hand, the above rotary table operating system B is constituted by a combination of the above rotor operating system A and the second transmission gear 10 fixed to the back face of the rotary table 12 so that it is rotatable with respect to the main shaft 2.

Each of the massaging rollers 3 comprises: an axle-like holding member 16 having its upper portion formed into two prongs; and a rolling element 18 held between the two prongs of the holding member 16 by a horizontal shaft 17 so that it can rotate freely.

The lower end of the holding member 16 is provided with a protruding support shaft 19, which is supported on the side of the top faces of the rotors 13 by bearings 20 buried in positions eccentric with the subordinate shafts 14. Hence, the massaging rollers 3 can rotate around the respective support shafts 19 independently of the rotors 13, so that the directions of the rotating elements 18 can be changed arbitrarily.

Figure 2:
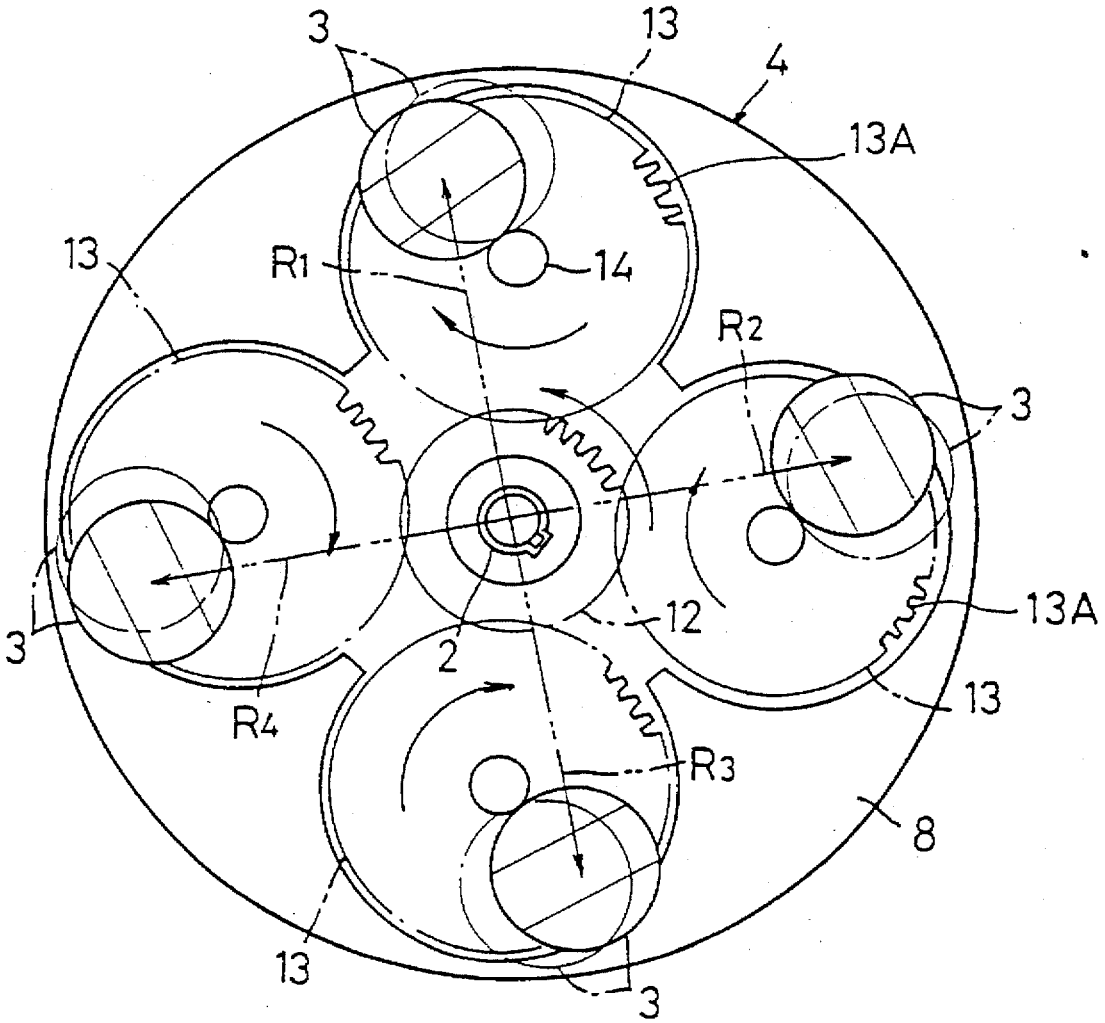
FIG. 2 is a plan view of FIG. 1.

As shown in FIG. 2, if the distances between the individual massaging rollers 3 and the main shaft 2 are represented by $R_1$, $R_2$, $R_3$, and $R_4$, the positions in which the individual rotors 13 are engaged in the central gear 12 are predetermined so that the equations $R_1=R_2=R_3=R_4$ are satisfied almost invariably even when the distances $R_1$, $R_2$, $R_3$, and $R_4$ are varied by the rotation of the rotors 13 around the respective subordinate shafts 14.

Accordingly, if any one of the massaging roller 3 moves in such a direction as to get closer to the main shaft 2 (or in such a direction as to get further away from the main shaft 2), the other massaging rollers 3 also move in the same direction, which enables the kneading movement of each of the massaging rollers 3 through the rotation of the corresponding rotor 13.

The casing 5 is composed of a main body supporting the main shaft 2 and a lid body 22 fixed to the upper end of the main body 21. The lower portion of the main shaft 2 is inserted through a pair of upper and lower bearings 23 buried in the main body 21, so that it is rotatably supported by the casing 5. In the upper part of the casing 5 are accommodated the above first and second transmission gears 11 and 10. On the right side in the casing 5 is provided a cylindrical guide hole 24, which is a through hole extending in parallel with the main shaft 2.

The driving means 6 comprises: an electric motor 26; a decelerator 27 connected directly to the motor 26 and internally provided with an epicyclic gear system; and a drive shaft 29 protruding from the decelerator 27. The driving means 6 is contained in a cylindrical slider 25, which has been inserted through the above guide hole 24 so that it can slide vertically. The decelerator 27 is placed in the upper part of the slider 25, while the drive shaft 29 is protruding upward from a top plate 28 of the slider 26.

To the midpoint of the drive shaft 29 is secured a first drive gear 31 to be engaged only in the first transmission gear 11. To the upper end of the drive shaft 29 is secured a second drive gear 30 to be engaged in the second transmission gear 10 or in the first transmission gear 11. The second drive gear 30 is designed to have the same diameter and the same number of teeth as the first drive gear 31.

In the present embodiment, the two drive gears 31 and 30 and the slider 25 constitute a switching means 32 for switching, through the vertical movement of the slider 25, between the case where the power of the drive shaft 29 is transmitted only to the first transmission gear 11 and the case where the power of the drive shaft 29 is transmitted to both of the first and second transmission gears 11 and 10.

Specifically, if the slider 25 is operated to slide the drive shaft 29 downward in the guide hole 24, as shown in FIG. 1, the second drive gear 30 comes to mesh with the first transmission gear 11 secured to the main shaft 2, while the second transmission gear 10 secured to the rotary table 4 is set free. Since the second transmission gear 10 can rotate freely with respect to the main shaft 2, the driving force of the drive shaft 29 is transmitted only to the central gear 12 via the main shaft 2, thereby rotating the central gear 12. The rotation of the central gear 12 in turn causes the individual rotors 13 to rotate around the respective subordinate shafts 14, which allows the massaging rollers 3 to move independently over the rotary table 4, resulting in kneading movement.

Figure 4:
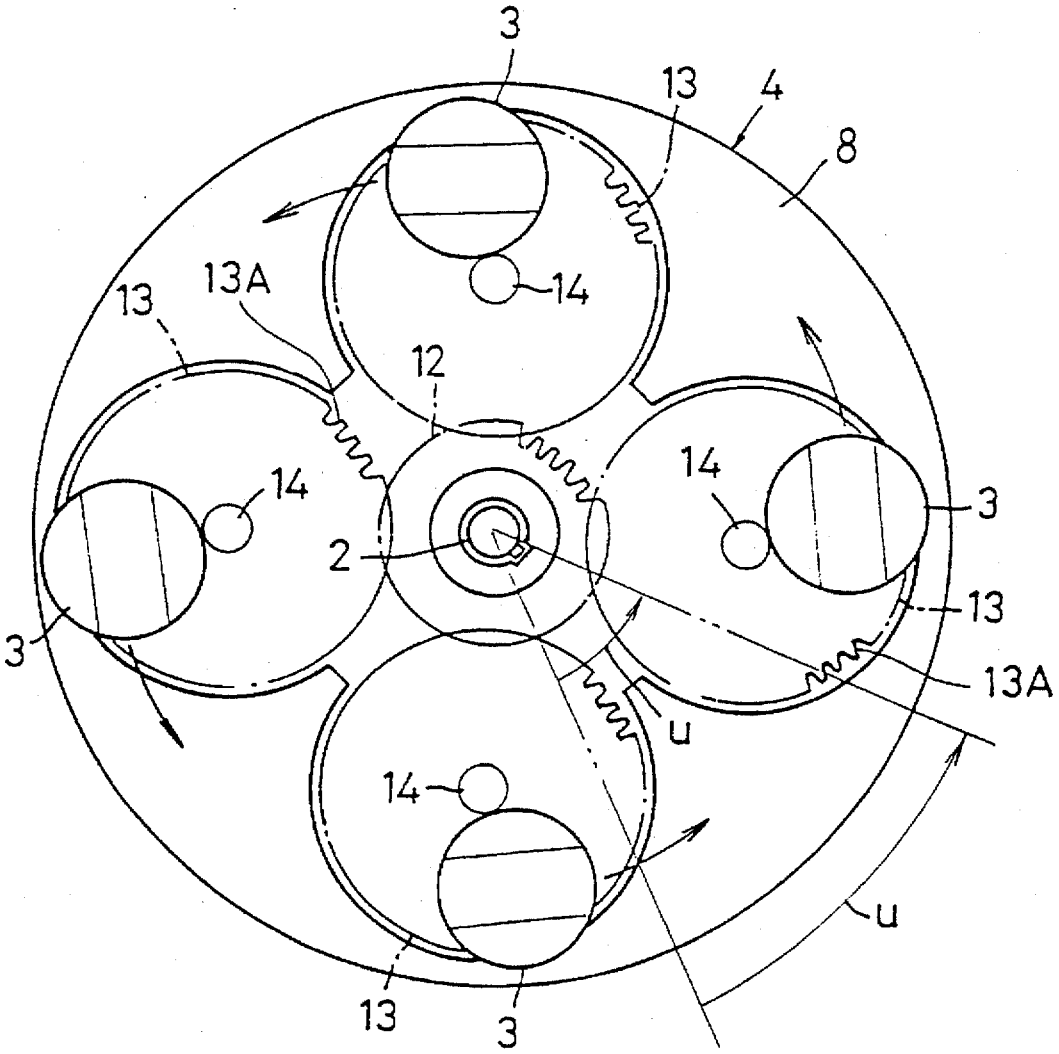
FIG. 4 is a plan view of FIG. 3.

Conversely, if the slider 25 is operated to slide the drive shaft 29 upward, as shown in FIG. 3, the second drive gear 30 comes to mesh with the second transmission gear. 10 secured to the rotary table 4, while the first drive gear 31 comes to mesh with the first transmission gear 11 secured to the main shaft 2. As mentioned above, the transmission gears 10 and 11 are designed to have the same number of teeth, while the drive gears 30 and 31 are designed to have the same number of teeth, so that the rotary table 4 and the central gear 12 rotate around the main shaft 2 at the same angular speed u, as shown in FIG. 4.

Consequently, the individual rotors 13 do not rotate around the respective subordinate shafts 14 independently of the rotary table 4 but revolve around the main shaft 2, while maintaining their relative positions with respect to the rotary table 4. As a result, the massaging rollers 3 revolve around the main shaft 2 and perform rolling movement.

Although the two separate gears 31 and 30 are adopted in the drawings by way of example, it is also possible to adopt a single drive gear which has a sufficient thickness to mesh with both of the first and second transmission gears 11 and 10.

In the case where massaging operation is switched from the kneading action to the rolling action, if the rotary table 4 is rotated with the second drive gear 30 being disengaged from the second transmission gear 10, the individual rotors 13 are allowed to rotate around the shaft 2 independently. Consequently, the distances R1, $R_2$, $R_3$, and $R_4$ between the respective massaging rollers 3 and the main shaft 2 can be changed, thereby expanding or reducing the range of massage resulting from the rolling action.

Figure 5:
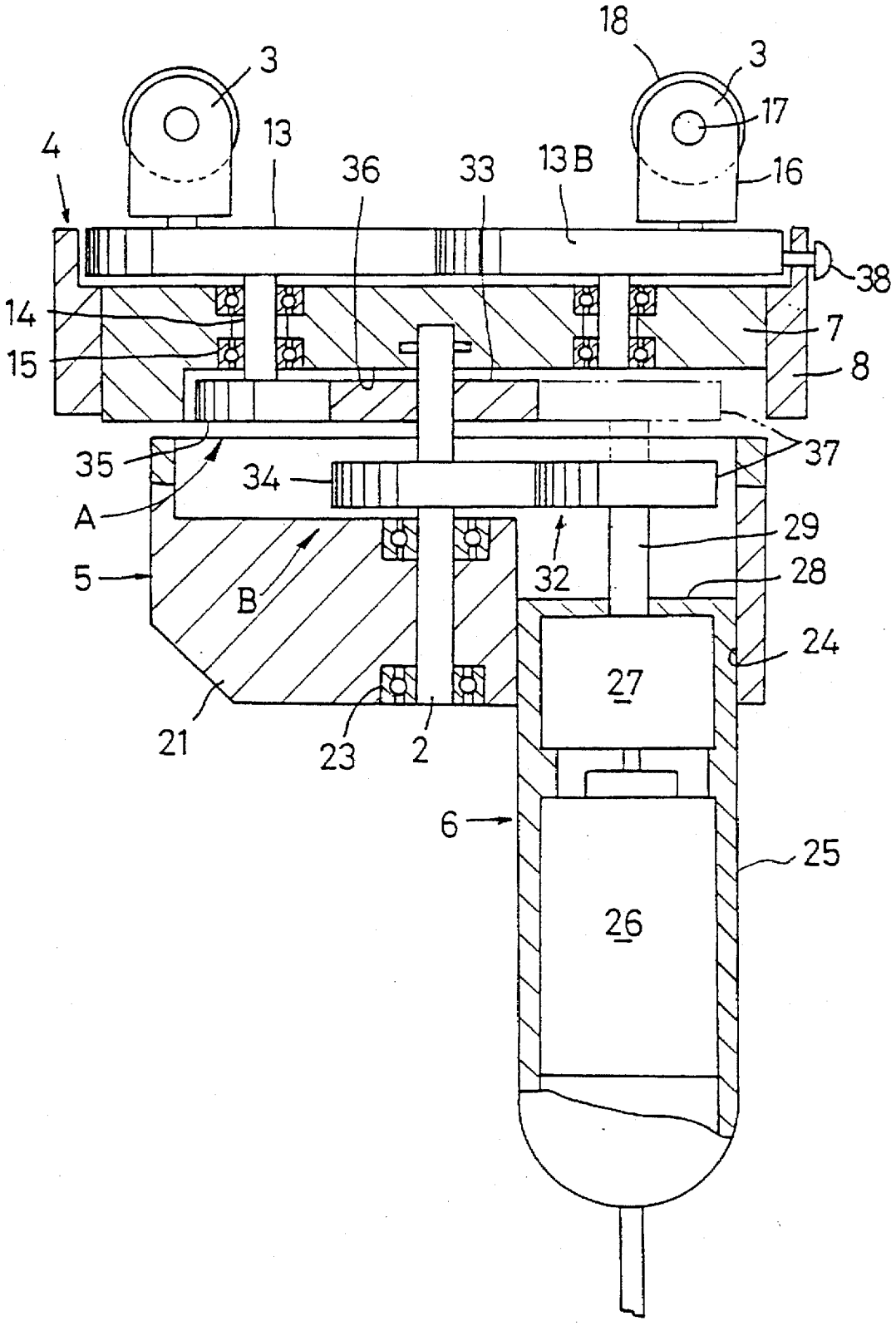
FIG. 5 is a front cross section of a roller massaging device according to a second embodiment.
Figure 6:
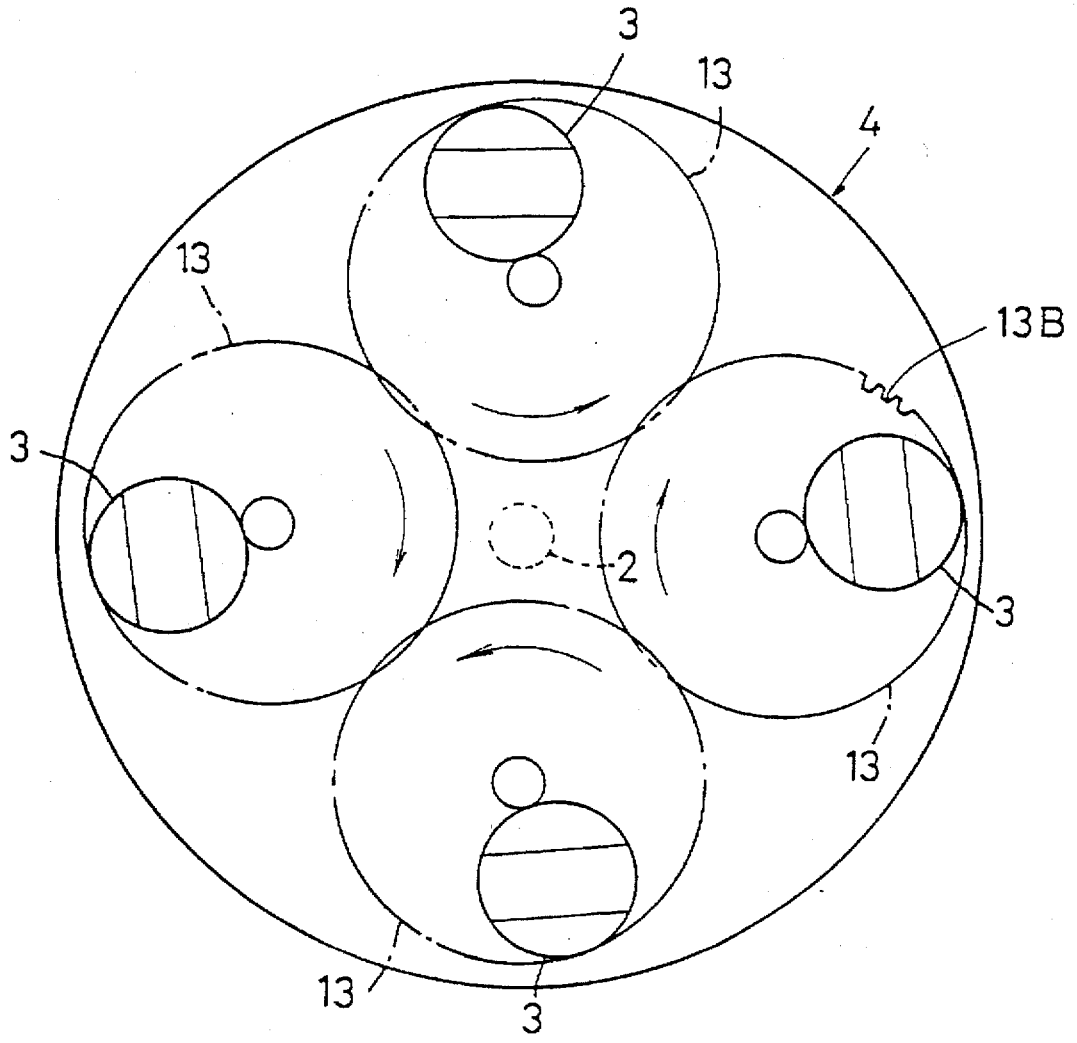
FIG. 6 is a plan view of FIG. 5.

Next, FIGS. 5 and 6 show a second embodiment of the present invention.

In the second embodiment, gears 13B formed around the respective rotors 13 are engaged in their respective adjacent ones and the central gear 12 provided in the first embodiment is not provided.

The main shaft 2 has its upper end fixed to the rotary table 4. The upper portion of the main shaft 2 is provided with a first transmission gear 33 composing the rotor operation system A so that it can rotate freely. To the midpoint of the main shaft 2 is secured a second transmission gear 34 composing the rotary table operating system B. The second transmission gear 34 is designed to have the same diameter and the same number of teeth as the first transmission gear 33.

Of the four subordinate shafts 14, to the lower end of one subordinate shaft 14 is fixed a relay gear 35 which is constantly engaged in the first transmission gear 33. The relay gear 35 together with the first transmission gear 33 are accommodated in a convex portion 36 for accommodation formed in the back face of the table body 7. On the other hand, to the drive shaft 29 of the driving means 6 is secured a single drive gear 37. With the sliding of the driving means 6 in the guide hole 24, the drive gear 37 is designed to mesh with the above first transmission gear 33 or with the second transmission gear 34.

Thus, in the case of the present embodiment, the rotor operating system A consists of: the gears 13B formed around the respective rotors 13; the above main shaft 2 having the rotary table 4 fixed to the upper end thereof; the subordinate shafts 14 rotatably inserted through the rotary table 4 and having the above respective rotors 13 fixed to the upper ends thereof; the relay gear 35 fixed to the lower end of one subordinate shaft 14 on the side of the back face of the rotary table 4; and the first transmission gear 33 constantly engaged in the relay gear 35 and provided rotatably with respect to the above main shaft 2. The rotary table operating system B of the present embodiment consists of: the main shaft 2; and the second transmission gear 34 fixed to the main shaft 2 in a position below the first transmission gear 33.

The switching means 32 of the present embodiment comprises: the drive gear 37 fixed to the drive shaft 29 extending in parallel with the main shaft 2; and the slider 25 for vertically moving a drive main shaft 6 in the casing 5, similarly to the first embodiment. However, the switching means 32 of the present embodiment further comprises a stopper 38 for inhibiting, when the drive gear 37 is engaged in the second transmission gear 34, the rotation of the rotors 13 around the respective subordinate shafts 14 and canceling the inhibition when the drive gear 37 is engaged in the first transmission gear 33. The stopper 38 is composed of a pin detachably provided in the circumferential side of the covering body 8 of the rotary table 4. If the tip of the pin is pressed onto the gear 13B of any one rotor 13, the rotation of the individual rotors 13 is inhibited.

As indicated by virtual lines in FIG. 5, if the driving means 6 is slid upward in the guide hole 24, the drive gear 37 comes to mesh with the first transmission gear 33 rotatable with respect to the main shaft 2. In this case, if the stopper 38 is disengaged from the rotor 13, the rotors 13 rotate around the respective subordinate shafts 14 via the first transmission gear 33 and the relay gear 35, which allows the individual massaging rollers 3 to move independently over the rotary table 4, resulting in kneading movement.

Conversely, if the driving means 6 is slid downward in the guide hole 24 to engage the drive gear 37 in the second transmission gear 34, the rotary table 4 is driven to rotate around the main shaft 2. Since the first transmission gear 33 is rotatable with respect to the main shaft 2, if the rotation of the rotor 13 is inhibited by means of the stopper 38, the rotors 13 do not rotate around the respective subordinate shafts 14 independently of the rotary table 4 but revolve around the main shaft 2, while maintaining their relative positions with respect to the rotary table 4, thereby causing the individual massaging rollers 3 to revolve around the main shaft 2, resulting in rolling movement.

Figure 7:
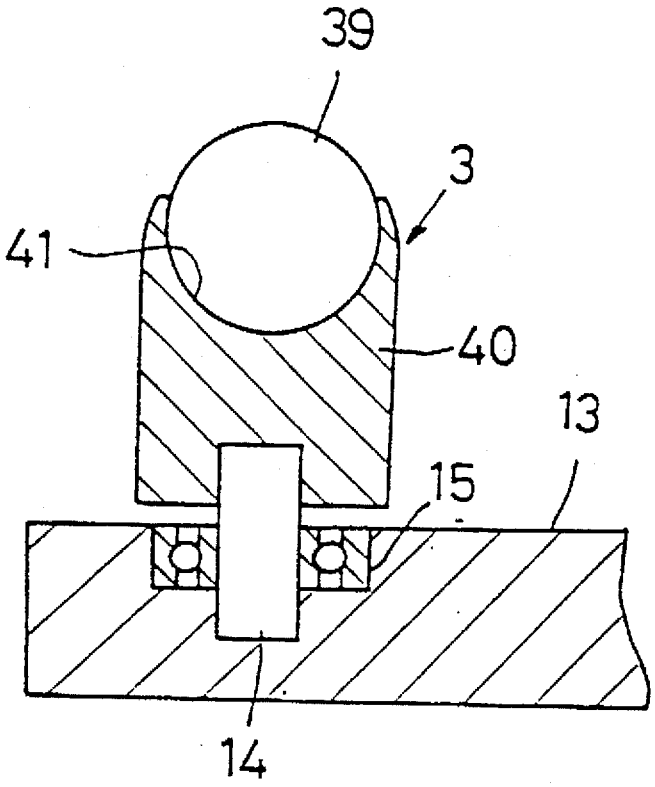
FIG. 7 is a cross section showing a variation of a massaging roller.

In the first and second embodiments described above, each of the massaging rollers 3 may alternatively be constituted as shown in FIG. 7. Each of the massaging rollers 3 of FIG. 7 comprises: an axle-like holding member 40 with a bearing portion 41 formed in the upper end thereof; and a ball 39 having its lower part fitted in the bearing portion 41 so that it can roll.

Figure 8:
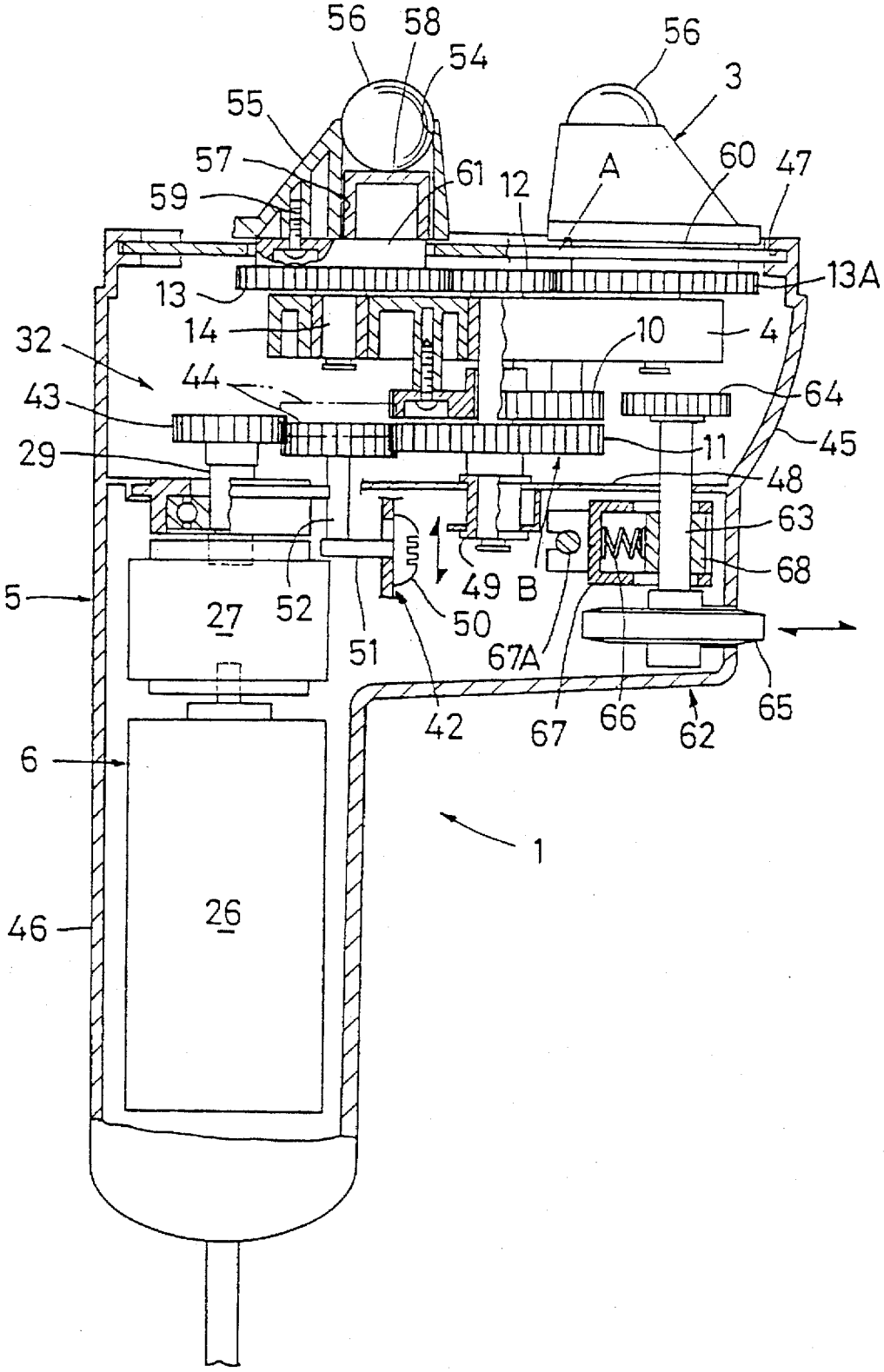
FIG. 8 is a front cross section of a roller massaging device according to a third embodiment.
Figure 9:
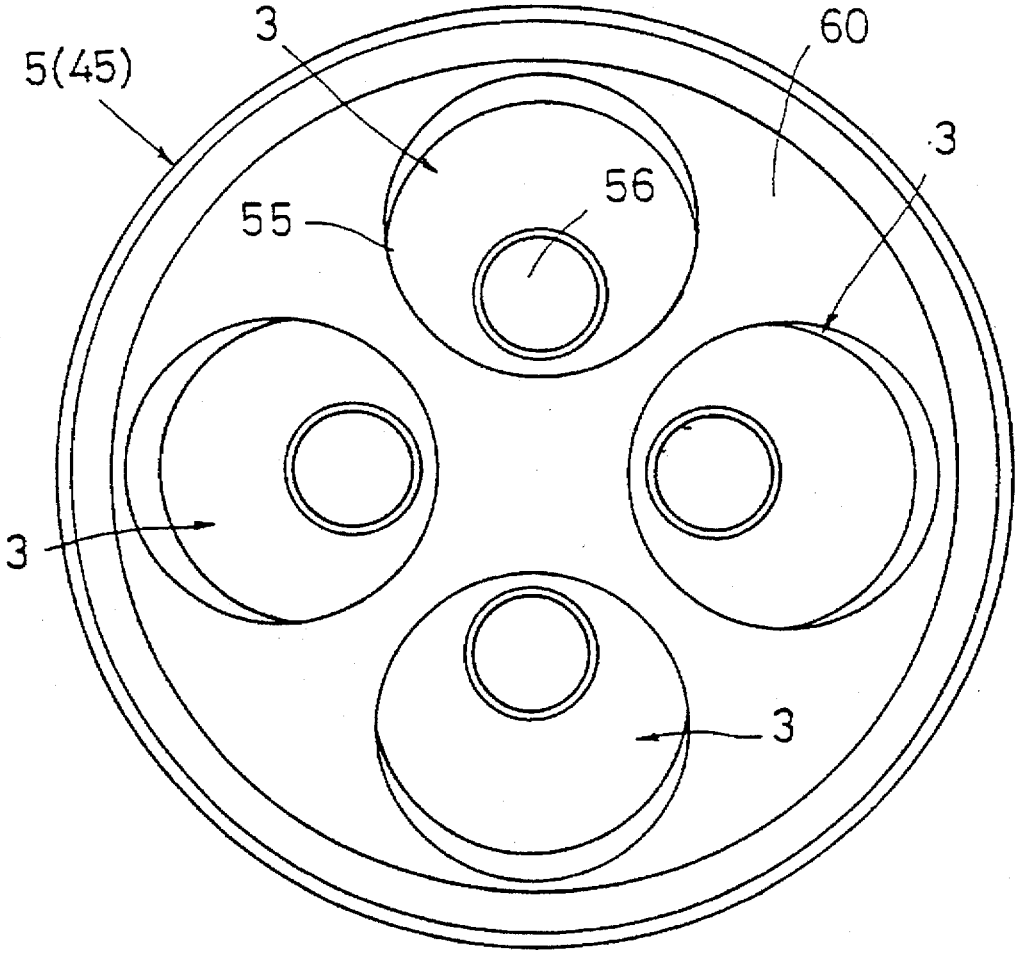
FIG. 9 is a plan view of FIG. 8.
Figure 10:
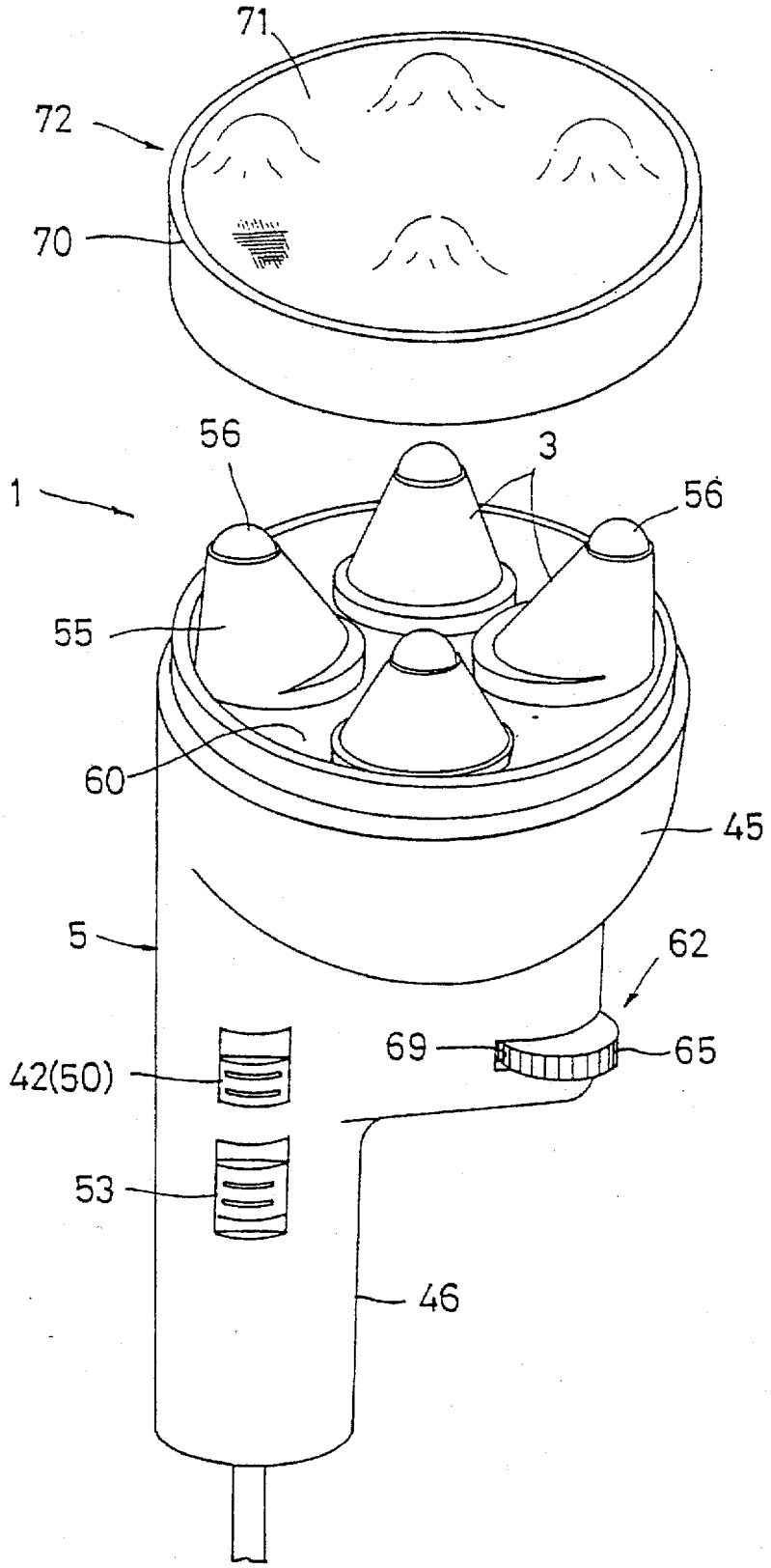
FIG. 10 is a perspective view of the roller massaging device according to the third embodiment.

FIGS. 8 to 10 show a third embodiment of the present invention.

In the third embodiment, the structures of the rotor operating system A and of the rotary table operating system B are the same as those adopted in the first embodiment. However, the third embodiment is different from the first and second embodiments in that the switching between the kneading action and the rolling action is performed by means of a change-over switch 42 provided in the casing 5, while it is performed by vertically moving the slider 25 in the first and second embodiments.

Specifically, the switching means 32 of the third embodiment comprises: a drive gear 43 fixed to the drive shaft 29 provided in parallel with the main shaft 2; an intermediate gear 44 constantly engaged in the drive gear 43 and provided between the drive gear 43 and the first and second transmission gears 11 and 10; and the change-over switch 42 for vertically moving the intermediate gear 44. If the change-over switch 42 is operated to move the intermediate gear 44 downward, the intermediate gear 44 comes to mesh only with the first transmission gear 11. Conversely, if the change-over switch 42 is operated to move the intermediate gear 44 upward, the intermediate gear 44 comes to mesh with both of the first and second transmission gears 11 and 10.

Thus, in the present embodiment, the driving means 6 consisting of the motor 26, decelerator 29, and drive shaft 29 is not designed to move vertically, so that it is contained in the casing 5.

The casing 5 is a hollow housing made of a plastic resin, which consists of a hemispheric holder 45 and a handle 46 positioned below and formed integrally with the hemispheric holder 45. The driving means 6 has been incorporated into the handle 46. The upper end of the holder 45 is formed with a circular opening and the inner edge of the circular opening is recessed to form a supporting groove 47. In the casing 5 is formed a partitioning wall 48 in the horizontal direction. In the central portion of the partitioning wall 48 is provided bearings 49 for supporting the lower end of the main shaft 2.

The change-over switch 42 comprises: a knob 50 provided on a side wall of the handle 46 so that it can move vertically; a bracket 51 having one end fixed to the inside of the knob 50 and protruding into the handle 46; and a shaft 52 fixed to the other end of the bracket 51 in the handle 46. On the shaft 52 is rotatably provided the above intermediate gear 44. A reference numeral 53 shown in FIG. 10 designates a change-over switch for turning on and off the power source of the motor 26.

Each of the massaging rollers 3 of the present embodiment comprises a holding member 55 with a bearing portion 54 formed in the upper end thereof; and a ball 56 contained in the bearing portion 54 so that it can roll. In this case, the holding member 55 presents a conic configuration with its vertex offset from the center of its base. In the holding member 55 is provided a cylindrical hole 57. On the side of the top faces of the rotors 13 and in positions eccentric with the subordinate shafts 14 are formed stages 58 for receiving the balls 56. The holding members 55 are attached to the respective rotors 13 by means of setscrews 59 so that the stages 58 are inserted into the above cylindrical holes 57.

Between the rotors 13 and the respective holding members 55 is provided a supporting plate 60 with which the rotors 13 and the rotary table 4 are supported by the casing 5. The supporting plate 60 has its circumferential edge fitted into the above supporting groove 47 and has four circular holes inside thereof. Into the circular holes are fitted circular seats 61 formed on the top faces of the respective rotors 13.

The massaging device 1 of the third embodiment further comprises a position changing means 62 for rotating, when the intermediate gear 44 is engaged only in the first transmission gear 11, the second transmission gear 10 so as to change the relative positions of the massaging rollers 3 with respect to each other.

The position changing means 62 comprises: an operating shaft 63 held vertically so that it can move transversely in the casing 5; an operating gear 64 fixed to the upper end of the operating shaft 63; a rotation operating body 65 fixed to the lower end of the operating shaft 63; and a spring 66 for biasing the operating shaft 63 in such a direction as to move further away from the main shaft 2.

In the casing 5 of FIG. 8, a supporting box 67 is fixed by means of a screw 67A in a position below the partitioning wall 48 and closer to the right end of the casing 5. The above operating shaft 63 is inserted through the supporting box 67 so that it can move transversely. That portion of the operating shaft 63 positioned inside the supporting box 67 is inserted through the sleeve 68 and the above spring 66 provided on the left side of the supporting box 67 presses the sleeve 68 to the right.

The operating gear 64 is positioned substantially flush with the second transmission gear 10 and is fixed to the upper end of the operating shaft 63 that has been extended to a point above the partitioning wall 48, so that it comes to mesh with the second transmission gear 10 when the operating shaft 63 is moved toward the main shaft 2. The rotation operating body 65 is disk-shaped and the circumferential edge thereof is exposed to the outside of the casing 5 through a hole 69 formed in the side wall of the casing 5.

If the position changing means 62 is to be used, the change-over switch 42 is lowered first and, after that, the rotation operating body 65 is rotated while it is pressed into the casing 5. Then, the first transmission gear 11 does not rotate since it is engaged in the intermediate gear 44, so that only the second transmission gear 10 is rotated via the operating gear 64. Consequently, the rotary table 4 rotates with the main shaft 2 being at rest, thereby changing the relative positions of the massaging rollers 3 with respect to each other.

As shown in FIG. 10, the roller massaging device 1 of the third embodiment comprises a covering member 72 composed of a ring frame 70 and a covering sheet 71 made of fabric or the like affixed to the ring frame 70. The covering member 72 is attached to the casing 5 by fitting the ring frame 70 onto the upper end of the holder 45.

It is also possible in the third embodiment to adopt the massaging rollers 3 shown in FIG. 1 or the massaging rollers 3 shown in FIG. 7.

The present invention may be embodied in other specific forms without departing from the essential characteristics thereof. For instance, although each of the embodiments described above has adopted a portable casing, casings according to the present invention include a flat casing and a casing to be incorporated into a chair.

The embodiments described in the present specification are illustrative and not restrictive. The scope of the invention, therefore, is to be determined solely by the following claims. All such modifications as fall within the spirit of the claims are embraced by the present invention.

In the following claims, the term "vertically" is used on the basis of the vertical direction in FIGS. 1, 3, 5, and 8. If the massaging device 1 is horizontally oriented, the term will indicate the horizontal direction.

The present invention is to be used in a massaging device for performing massage resulting from kneading action or rolling action with respect to a human body.

What is claimed is:

1. A roller massaging device comprising:

a casing;

a main shaft vertically extending and rotatably inserted through the casing;

a rotary table having a central portion coupled to an upper end of said main shaft;

a plurality of rotors rotatably provided above a top face of said rotary table by means of subordinate shafts each extending in parallel with said main shaft;

massaging rollers positioned above the rotors eccentrically with said subordinate shafts;

a rotor operating system for causing said rotors to rotate around said respective subordinate shafts;

a rotary table operating system for causing said rotary table to revolve around said main shaft, while said rotors and said respective subordinate shafts do not rotate relative to the rotary table; and driving means for activating either one of said rotor operating system and said rotary table operating system.

2. The roller massaging device according to claim 1, wherein said rotor operating system comprises individual gears formed around said respective rotors, said main shaft rotatable with respect to said rotary table, a central gear engaged in said individual gears and fixed to the upper end of said main shaft, and a first transmission gear fixed to said main shaft in a position below said rotary table, and said rotary table operating system includes a combination of said rotor operating system and a second transmission gear fixed to a back face of said rotary table so that said second transmission gear can rotate with respect to said main shaft, said second transmission gear having the same number of teeth as said first transmission gear.

3. The roller massaging device according to claim 2, wherein said driving means has a motor and a drive shaft driven by the motor, and further including switching means for switching between the case where power of the drive shaft is transmitted only to said first transmission gear and the case where the power of the drive shaft is transmitted to both of said first and second transmission gears.

4. The roller massaging device according to claim 1, wherein each of the massaging rollers comprises a holding member having an upper portion formed into two prongs, and a rolling element held between the two prongs of the holding member by a horizontal shaft so that the rolling element can roll freely.

5. The roller massaging device according to claim 1, wherein each of the massaging rollers comprises a holding member with a bearing portion formed in an upper end thereof, and a ball fitted in the bearing portion so that the ball can roll.

6. A roller massaging device comprising:

a casing;

a main shaft vertically extending and rotatably inserted through the casing;

a rotary table having a central portion coupled to an upper end of said main shaft;

a plurality of rotors rotatably provided above a top face of said rotary table by means of subordinate shafts each extending in parallel with said main shaft;

massaging rollers positioned above the rotors eccentrically with said subordinate shafts;

a rotor operating system for causing said rotors to rotate around said respective subordinate shafts;

a rotary table operating system for causing said rotary table to revolve around said main shaft while said rotors and said respective subordinate shafts do not rotate relative to the rotary table; and driving means for activating either one of said rotor operating system and said rotary table operating system, wherein said rotor operating system comprises individual gears formed around said respective rotors, said main shaft rotatable with respect to said rotary table, a central gear engaged in said individual gears and fixed to the upper end of said main shaft, and a first transmission gear fixed to said main shaft in a position below said rotary table, said rotary table operating system comprises a combination of said rotor operating system and a second transmission gear fixed to a back face of said rotary table so that said second transmission gear can rotate with respect to said main shaft, said second transmission gear having the same number of teeth as said first transmission gear, said driving means has a motor and a drive shaft driven by the motor, and switching means for switching between the case where power of the drive shaft is transmitted only to said first transmission gear and the case where the power of the drive shaft is transmitted to both of said first and second transmission gears, and said switching means comprises first and second drive gears each fixed to said drive shaft provided in parallel with said main shaft, and a slider for vertically moving said driving means inside said casing, whereby if said slider is operated to move said drive shaft downward, said second drive gear comes to mesh only with said first transmission gear, and if said slider is operated to move said drive shaft upward, said first and second drive gears come to mesh with said first and second transmission gears, respectively.

7. The roller massaging device according to claim 6, wherein each of the massaging rollers comprises a holding member having an upper portion formed into two prongs, and a rolling element held between the two prongs of the holding member by a horizontal shaft so that the rolling element can roll freely.

8. A roller massaging device comprising:

a casing;

a main shaft vertically extending and rotatably inserted through the casing;

a rotary table having a central portion coupled to an upper end of said main shaft;

a plurality of rotors rotatably provided above a top face of said rotary table by means of subordinate shafts each extending in parallel with said main shaft;

massaging rollers positioned above the rotors eccentrically with said subordinate shafts;

a rotor operating system for causing said rotors to rotate around said respective subordinate shafts;

a rotary table operating system for causing said rotary table to revolve around said main shaft while said rotors and said respective subordinate shafts do not rotate relative to the rotary table; and driving means for activating either one of said rotor operating system and said rotary table operating system, wherein said rotor operating system comprises individual gears formed around said respective rotors, said main shaft rotatable with respect to said rotary table, a central gear engaged in said individual gears and fixed to the upper end of said main shaft, and a first transmission gear fixed to said main shaft in a position below said rotary table, said rotary table operating system comprises a combination of said rotor operating system and a second transmission gear fixed to a back face of said rotary table so that said second transmission gear can rotate with respect to said main shaft, said second transmission gear having the same number of teeth as said first transmission gear, said driving means has a motor and a drive shaft driven by the motor, and switching means for switching between the case where power of the drive shaft is transmitted only to said first transmission gears and the case where the power of the drive shaft is transmitted to both of said first and second transmission gears, and said switching means comprises a drive gear fixed to said drive shaft provided in parallel with said main shaft, an intermediate gear constantly engaged in the drive gear and interposed between the drive gear and said first and second transmission gears, and a change-over switch for vertically moving the intermediate gear, whereby if the change-over switch is operated to move said intermediate gear downward, said intermediate gear comes to mesh only with said first transmission gear, and if the change-over switch is operated to move said intermediate gear upward, said intermediate gear comes to mesh with both of said first and second transmission gears.

9. The roller massaging device according to claim 8, further comprising position changing means for rotating said second transmission gear so as to change the relative positions of said massaging rollers with respect to each other.

10. The roller massaging device according to claim 9, wherein the position changing means comprises an operating shaft which extends vertically and which is held so that it can move transversely in said casing, an operating gear which is fixed to one end of the operating shaft and which comes to mesh with said second transmission gear when said operating shaft is moved toward said main shaft, a rotation operating body which is fixed to the other end of said operating shaft, and a spring which normally biases said operating shaft in such a direction as to move further away from said main shaft in order to keep said operating gear away from said second transmission gear.

11. The roller massaging device according to claim 8, wherein each of the massaging rollers comprises a holding member with a bearing portion formed in an upper end thereof, and a ball fitted in the bearing portion so that the ball can roll.

12. A roller massaging device comprising:

a casing;

a main shaft vertically extending and rotatably inserted through the casing;

a rotary table having a central portion coupled to an upper end of said main shaft;

a plurality of rotors rotatably provided above a top face of said rotary table by means of subordinate shafts each extending in parallel with said main shaft;

massaging rollers positioned above the rotors eccentrically with said subordinate shafts;

a rotor operating system for causing said rotors to rotate around said respective subordinate shafts;

a rotary table operating system for causing said rotary table to revolve around said main shaft while said rotors and said respective subordinate shafts do not rotate relative to the rotary table; and driving means for activating either one of said rotor operating system and said rotary table operating system, wherein said rotor operating system comprises gears formed around said respective rotors and engaged with respective adjacent ones of said gears, said main shaft having said rotary table fixed to the upper end thereof, said subordinate shafts rotatably inserted through said rotary table and having said rotors fixed to upper ends thereof, a relay gear fixed to a lower end of any one of said subordinate shafts on the side of a back face of said rotary table, and a first transmission gear constantly engaged in the relay gear and provided rotatably with respect to said main shaft, and said rotary table operating system comprises said main shaft and a second transmission gear fixed to said main shaft in a position below said first transmission gear.

13. The roller massaging device according to claim 12, wherein said driving means has a motor and a drive shaft driven by the motor and switching means for switching between the case where power of the drive shaft is transmitted to said first transmission gear and the case where the power of the drive shaft is transmitted to said second transmission gear.

14. The roller massaging device according to claim 13, wherein said switching means comprises a single drive gear fixed to said drive shaft provided in parallel with said main shaft, and a slider for vertically moving said driving means inside said casing, whereby if the slider is operated to move said drive shaft upward, said drive gear comes to mesh with said first transmission gear, and if the slider is operated to move said drive shaft downward, said drive gear comes to mesh with said second transmission gear.

15. The roller massaging device according to claim 14, wherein said switching means further comprises a stopper which inhibits the rotation of said rotors around said respective subordinate shafts when said drive gear is engaged in said second transmission gear and which cancels the inhibition when said drive gear is engaged in said first transmission gear.

16. The roller massaging device according to claim 12, wherein each of the massaging rollers comprises a holding member having an upper portion formed into two prongs, and a rolling element held between the two prongs of the holding member by a horizontal shaft so that the rolling element can roll freely.

* * * * *